United States Patent [19]

Buck et al.

[11] Patent Number: 4,700,787

[45] Date of Patent: Oct. 20, 1987

[54] POWER TONG TORQUE CONTROL

[76] Inventors: David A. Buck, 4225 Hwy. 90 East, Broussard, La. 70518; Ronald N. James, 111 Edie Ann Dr., Apt. 137, Lafayette, La. 70508

[21] Appl. No.: 783,698

[22] Filed: Oct. 3, 1985

[51] Int. Cl.[4] ..... E21B 5/00

[52] U.S. Cl. ..... 173/164; 173/12; 81/470

[58] Field of Search ..... 173/12, 164, 100; 81/470

[56] References Cited

U.S. PATENT DOCUMENTS 3,745,820 7/1973 Weiner ..... 173/12
3,980,143 9/1976 Swartz et al. ..... 173/164 X
4,091,451 5/1978 Weiner et al. ..... 173/12 X
4,199,032 4/1980 Weiner et al. ..... 173/12
4,305,472 12/1981 Brossette ..... 173/12

*Primary Examiner*—E. R. Kazenske
*Assistant Examiner*—Willmon Fridie, Jr.
*Attorney, Agent, or Firm*—John D. Jeter

[57] ABSTRACT

Apparatus for controlling the torque delivered to pipe connections by power tongs by utilizing the reaction torque to cause a proportional fluid by-pass to be bled from the drive motor fluid power supply to slow the motor as torque increases, and to stop the motor at some preselected torque quantity. The torque is maintained as long as the operator provides fluid power to the motor circuit to overcome brief torque resistances due to such as pipe wobble.

5 Claims, 2 Drawing Figures

POWER TONG TORQUE CONTROL

BACKGROUND

Power tongs have been around for many years, and efforts to control the output torque are not new. The major problem with torque control has been related to the inertia involved in the system including the pipe being rotated. Threaded joints occur about every thirty feet in a pipe string, and several hundred are involved in a common well bore related installation. Economic considerations urge speed in pipe joint make-up, and this speed contributes to the problems involved. Pipe threads are commonly tapered, and most have shoulders. Jamming the shoulders together with the pipe rapidly spinning is called "bumping," and such bumping is destructive.

In recognition of the bumping problem, many organizations have demanded recordings made of torque applied to pipe joints. There is no proven way, however, to record from torque load cells, the torque supplied from the energy of a rapidly spinning pipe suddenly shouldered to the mating thread.

To compensate for the lack of control over torque applied to pipe used, for instance, in hydrogen sulfide service, the pipe is often rotated by hand until the shoulder is approached. Powered tongs usually then complete the torque program.

Efforts to control torque have involved sensors to trigger drive motor shut down when torque reached reselected values. Since pipe joints often wobble about as assembly proceeds, the triggering torque can be sensed from jamming before the shoulders are in contact. Hopefully, such conditions are always detected, and additional torque efforts can correct the impending problem. This, however, is risky and costly.

It is desireable to have a power tong that will slow down as torque is sensed, even to the point of stopping when desired torque is achieved, yet hold the torque through brief jamming incidents and finish the task, even if motion is intermittent.

It is therefore an object of this invention to provide apparatus to reduce the speed of power tongs as soon as torque resistance is sensed.

It is a further object of this invention to provide apparatus to limit torque that is delivered by power tongs, yet hold the torque applied as long as the power tong operator holds the power tong manual control valve open.

It is still another object of this invention to provide apparatus to control power tong torque that will stop power tong rotation when unstable conditions cause transient resistance, yet continue rotation when such transients pass until the connection is satisfactorily completed.

It is yet a further object of this invention to utilize a conventional hydraulic load cell in the tong tension line to directly and proportionately regulate the means to limit the ability of the power tong drive motor to deliver both space and torque.

It is still another object of this invention to provide apparatus to slow the speed of a power tong as torque is first sensed, and to finally limit torque as rotation of pipe gradually ceases.

These and other objects, advantages, and features of this invention will be apparent to those skilled in the art from a consideration of this specification, including the attached drawings and appended claims.

SUMMARY OF THE INVENTION

On a conventional power tong with a fluid drive motor and a motor direction control valve, connected to a separate fluid power source, a by-pass valve is connected to the fluid power supply line. The by-pass valve is, preferably, situated to by-pass fluid from the supply line to the conventional fluid outlet line, whether open to the atmosphere for air or returned to a hydraulic power source sump. The by-pass valve is adjustably biased toward a closed position and arranged to open in response to a selected output pressure from a tension load cell in the tong tag line. When tong output torque produces tension in the tag line, in excess of a preselected amount, the by-pass valve begins to open and reduces the amount of fluid available, from a finite power source, to power the tong drive motor. The by-pass valve, as an alternate flow path controls both volume and pressure to, and consequently both speed and torque produced by, the tong drive motor, if response to tong output torque sensed.

BRIEF DESCRIPTION OF DRAWINGS

In the drawings, wherein like reference characters are used throughout to designate the parts.

DETAILED DESCRIPTION OF DRAWINGS

Figure 1:
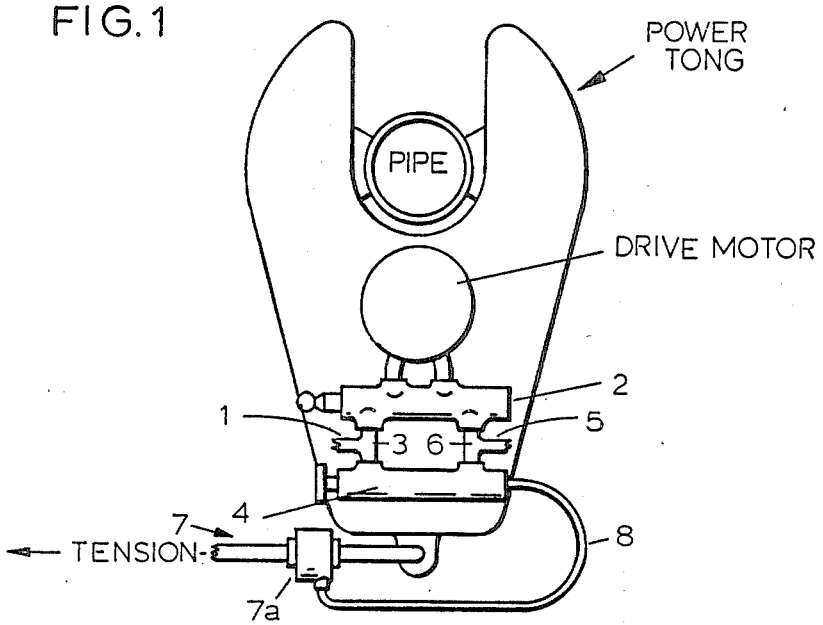
FIG. 1 is a plan view of a power tong in the usual use configuration, with novel apparatus of this invention in place.
Figure 1:
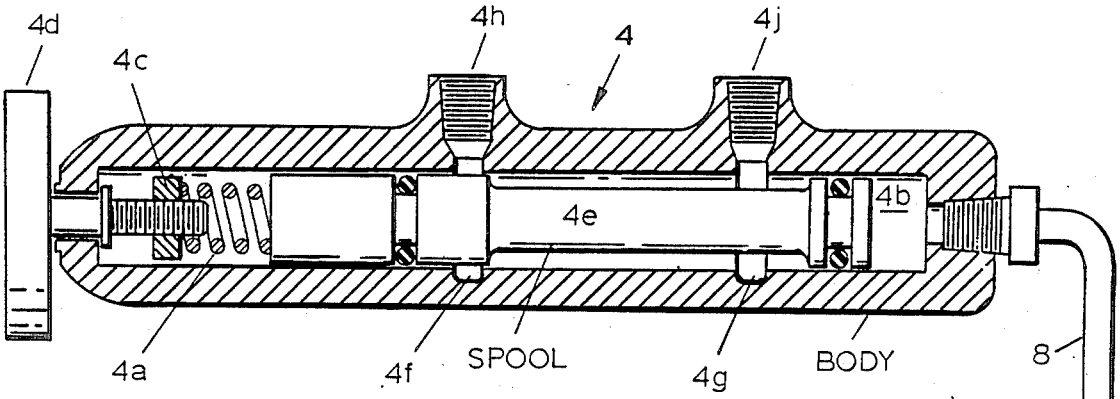

In FIG. 1, the power tong is situated around the pipe, which is vertical along the extended centerline of a well bore. Rig hydraulic power is provided to the system by way of hose 1, which goes to the manual control valve 2, and on to the drive motor. There is a tee 3 in the hydraulic line between the source and the drive motor. A line connected to the tee leads to the by-pass valve 4 and, if permitted, allows fluid flow through valve 4 and on to the rig hydraulics reservoir. A general fluid return line 5 extends from the drain side of the valve 2, which is a four port valve, to the rig hydraulics reservoir. The by-pass flow from valve 4 is dumped into the general fluid return line 5 by way of a tee 6.

The tension line 7, commonly called a tag line, is attached to some fixed structure related to the drilling rig, and extends to the power tong frame. A hydraulic load cell 7a is part of the tag line. As tension builds in the tag line because of torque developed by the power tong, hydraulic pressure increases in the load cell. The pressure in the load cell is conducted by line 8 to the by-pass valve 4. By processes to be described later, pressure in the load cell causes the by-pass valve to dump fluid from the fluid supply line before it reaches the drive motor. As tension builds up in the load cell, the motor slows down and stops. At the time the drive motor stops, the selected tension must exist in the tag line. If the tension is reduced after temporary torque transients are cleared, fluid will again go to the motor, and it will rotate the pipe until the preselected torque is reestablished.

Figure 2:
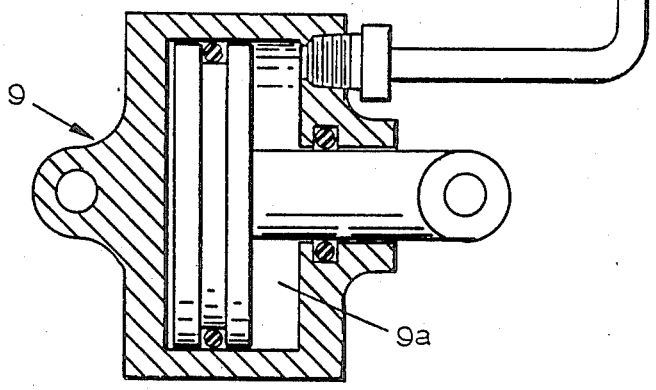
FIG. 2 is a plan view in partial cutaway of the novel apparatus of this invention.

FIG. 2 represents the essence of the points of novelty of this invention. The by-pass valve 4 and the load cell **7*a* that influence by-pass flow are partly cut away to emphacise the primary elements. FIG. 2 shows a specific embodiment of the load cell and the load cell is captioned 9**.

The load cell 9 is part of the tag line that applies tension to a power tong frame, as a momemt arm, to oppose reaction torque. These cells are often diaphram units, but the one shown here is a hydraulic cylinder with appropriate piston and rod seals. Hydraulic pressure in the fluid chamber 9*a* is obviously proportional to tag line tension, if friction is ignored.

The valve body houses a valve spool that is free to slide in the body bore. The spool is urged to the right by spring 4*a* and urged to the left by any fluid pressure in the fluid cylinder 4*b*. The spring 4*a* is adjusted by movement of follower 4*c*, which results from turning handwheel 4*d*. The follower 4*c* is held non-rotative in the body by a tang and groove arrangement (not shown). The follower engages the threads on the handwheel shaft and moves axially as the handwheel is turned.

The valve spool has groove 4*e* cooperating with annulus 4*f* and annulus 4*g* to control flow of fluid from port 4*h* to port 4*j*. When the spool is farthest left, flow is permitted between the ports. When the spool is moved to the right, flow between the ports is restricted. The spring then, in effect, tends to close the by-pass, and the pressure in the fluid cylinder, urging the spool left, tends to open the by-pass. For any selected spring load setting, there is a corresponding cylinder pressure, tag line tension, and hence torque, that will just cause pipe rotation to stop. As the valve spool approaches that cut-off position, more and more fluid is bypassed from port 4*h* to port 4*j*, and the drive motor slows proportionately.

Otherwise stated, by-pass means (valve 4) responds to the pressure signal from the sensor means (load cell 7*a* or 9) to make the tong drive motor responsive to torque produced by the tong. A conventional power tong has control valve 2 to control the direction of rotation of the drive motor. All known fluid powered pipe tongs have a four way valve 2. By-pass valve 4 is, preferably, in parallel with the four way valve 2. The by-pass valve can be any size and, hence, can by-pass any finite amount of fluid available through hose 1 to reduce, by any amount, fluid power available to the drive motor.

At any tong torque output level, load cell 9, sensing torque produced tension in tension (or tag) line 7 will produce a proportional fluid pressure in line 8 and in cylinder 4*b*. The load cell side 9*a*, line 8 and cylinder 4*b* is a, fluid filled, closed system. The spool of valve 4 assumes an equilibrium position determined by adjustable bias means (spring 4*a*) and the force produced by the piston end of the valve spool in cylinder 4*b*.

As the spool of valve 4 moves left in the valve body it opens a flow channel between ports 4*h* and 4*j*. The amount of flow area between the two ports is determined by the relative forces of spring 4*a* and the piston in cylinder 4*b*. This relates the position of the spool to torque produced by the tong. Ports 4*h* and 4*j* are in common with fluid circuitry tees 1 and 5 respectively.

Any torque load on the drive motor will produce a corresponding pressure difference between lines 1 and 5. This pressure can cause any part, or all, of the available fluid to by-pass the drive motor, depending upon the position of the spool of valve 4. The by-pass optional route, then, determines both speed and torque that the drive motor can produce.

When the power source is in communication with the drive motor, valve 2 is assumed to be open to a selected side of the motor fluid circuitry.

The valve spool is shown to terminate on the right end in a hydraulic piston. A diaphram is currently being used instead, but the effect of converting fluid pressure to force to oppose spring bias is the same.

It should be pointed out that the preferred use of a hydraulic load cell in the common tag line is a matter of convenience. The by-pass valve can be of any practical form, and the output signal from a torque sensor can be mechanical as well as hydraulic. For example, a rugged rotary valve can be used to control by-pass flow, and the usual control handle can be spring centered and move by a tension line. Adjustability, proportionally between torque and bypass. as well as torque holding ability, would be achievable by such detail changes, and this fact is anticipated by the claims.

Power tongs are commonly powered by available rig hydraulics, and the preferred embodiment defers to this practice. Electric motors, however, can drive power tongs, and this fact is anticipated by the claims.

The preferred embodiment of this invention utilizes variable by-pass flow from a finite available flow to throttle and finally stop a drive motor. This arrangement is preferred over the option of using a fluid power source of finite available pressure and using the present by-pass in series with the manual control valve to limit flow to the drive motor. The series valve does not fail safe, and small leakage can allow torque to creep up to dangerous levels. This option exists, however, and is anticipated by the claims.

From the foregoing, it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the apparatus of this invention without departing from the scope thereof, it is to be understood that all matter herein set forth or shown in the accompanying drawings is to be interpreted as illustrative, and not in a limiting sense.

The invention having been described, what is claimed is:

1. Torque controlled powered pipe tongs, the apparatus comprising:

(a) a power tong powered by a fluid motor;

(b) a fluid power source connected to said motor;

(c) a force conducting element attached to said power tong, situated to oppose reaction torque from said tongs when torque is applied to pipe;

(d) force sensing means operatively associated with said force conducting element situated to sense at least part of the force experienced by said force conducting element, arranged to produce a pressure signal proportional to force sensed; and (e) a fluid by-pass valve, adjustably biased toward a closed position, responsive to said signal to tend to move toward an open position, said by-pass valve connected between said fluid power source and said motor.

2. The apparatus of claim 1, further provided with means to adjust the force of said bias.

3. The apparatus of claim 1, further providing that said force sensing means comprises a bellows arranged to produce hydraulic pressure in response to force.

4. The apparatus of claim 1 further provided with a manual flow control valve in the fluid circuit between said fluid power supply and said motor.

5. Torque controlled power tongs for manipulation of threaded pipe connections, the apparatus comprising:

(a) a power tong powered by a fluid driven motor;

(b) a fluid power source communicated to said motor;

(c) means to sense torque applied to pipe being rotationally driven by said power tong, capable of producing an output fluid pressure signal proportional to said torque;

(d) by-pass means, responsive to said fluid pressure signal, situated to by-pass fluid available to said motor into a motor by-pass channel, said by-pass means comprising a spool valve with a manually adjustable spring bias urging said by-pass valve toward a closed position, and a fluid piston responsive to said fluid pressure signal, situated to urge said by-pass valve toward an open position.

* * * * *